US007922504B2

(12) United States Patent
Sakamaki et al.

(10) Patent No.: US 7,922,504 B2
(45) Date of Patent: Apr. 12, 2011

(54) LEVER-TYPE CONNECTOR

(75) Inventors: Kazushige Sakamaki, Tokyo (JP); Ryuichi Komiyama, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/897,110

(22) Filed: Oct. 4, 2010

(65) Prior Publication Data

US 2011/0021048 A1 Jan. 27, 2011

Related U.S. Application Data

(63) Continuation of application No. PCT/JP2009/056124, filed on Mar. 26, 2009.

(30) Foreign Application Priority Data

Apr. 4, 2008 (JP) ..... 2008-098017

(51) Int. Cl.
*H01R 13/62* (2006.01)

(52) U.S. Cl. ..... 439/157

(58) Field of Classification Search ..... 439/157, 439/160, 310, 372, 140, 752, 136, 145, 686, 439/489, 595, 871, 347, 465
See application file for complete search history.

(56) References Cited

U.S. PATENT DOCUMENTS 6,358,101 B1 * 3/2002 Noro et al. ..... 439/752
7,513,784 B2 * 4/2009 Shibata ..... 439/157
7,559,778 B2 * 7/2009 Pittenger et al. ..... 439/157
2009/0221167 A1 * 9/2009 Pittenger et al. ..... 439/157
2010/0178791 A1 * 7/2010 Komiyama et al. ..... 439/347

FOREIGN PATENT DOCUMENTS

JP 10-241773 A 9/1998
JP 2000-133375 A 5/2000
JP 2006-331991 A 12/2006
JP 2007-188783 A 7/2007
JP 2007-227236 A 9/2007
JP 2007-234420 A 9/2007

OTHER PUBLICATIONS

International Search Report for co-pending International Application No. PCT/JP2009/056124, 2 pages dated Apr. 21, 2009.

* cited by examiner

*Primary Examiner* — Edwin A. Leon
(74) *Attorney, Agent, or Firm* — Barley Snyder LLC

(57) ABSTRACT

A lever-type connector capable of securely and efficiently carrying out a secondary latch onto a contact by a retainer and release of the secondary latch is provided. The lever-type connector includes an inner housing, an outer housing, a retainer, a slider, a lever and a first and second retainer operation passageway. The inner housing includes a contact receiving passageway for receiving a contact, which is latched by a retainer inserted into the inner housing. The inner housing is inserted into and received by the outer housing. The slider is movable within the outer housing and having a cam groove into which a cam pin provided on the mating connector is inserted. The lever is attached to the outer housing and moves the slider by rotation of the lever. The first retainer operation passageway is positioned on a side surface of the outer housing, while the second retainer operation passageway is located on the slider. The first retainer operation passageway is in communication with the second retainer operation passageway when the slider is set to a mated position.

13 Claims, 7 Drawing Sheets

Prior Art

Prior Art

LEVER-TYPE CONNECTOR

CROSS-REFERENCE TO RELATED APPLICATIONS

This application is a continuation of PCT International Application No. PCT/JP2009/056124, filed Mar. 26, 2009, which claims priority under 35 U.S.C. §119 to Japanese Patent Application No. JP 2008-098017, filed Apr. 4, 2008.

FIELD OF THE INVENTION

The present invention relates to a connector and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

Here, the lever-type connector design has adopted a retainer to prevent a contact that is received in a contact receiving passageway in an inner housing from falling out of the contact receiving passageway. The retainer secondarily latches onto the contact received in the contact receiving passageway. Moreover, this type of lever-type connector has adopted a configuration where the retainer is arranged inside of an outer housing in order to prevent the latch on the contact by the retainer from unintentionally being released due to exertion of external force on the retainer.

However, the lever-type connector having a retainer arranged inside of an outer housing, a problem occurs in that it is difficult to move the retainer from a released position to a locked position when latching the retainer onto the contact.

A conventional lever-type connector 100 shown in FIGS. 10 to 13, for example, is well-known, which is used to solve the above problem. The lever-type connector 100 includes a housing 110 that receives a contact 101 (see FIG. 12 and FIG. 13), a wire cover 120 that covers an electrical wire 102 (see FIG. 12 and FIG. 13) lead out from the contact in the housing 110, and a lever 130 for mating with a mating connector 200.

As shown in FIG. 10 and FIG. 11, the housing 110 includes an inner housing 140 having multiple contact receiving passageways 141 in which the contact 101 is received, and an outer housing 150 that receives the inner housing 140.

A retainer receiving depression 142 that opens upward is provided on the inner housing 140, as shown in FIG. 12 and FIG. 13. A retainer 160 that secondarily latches on to the contact 101 is inserted into the retainer receiving depression 142. Moreover, a tool insertion passageway 143 is provided on the rear surface of the inner housing 140, into which a tool 210 for operating the retainer 160 is to be inserted.

A retainer insertion passageway 151 in which the retainer 160 is to be inserted is provided on the top surface of the outer housing 150.

When receiving the contact 101 in the contact receiving passageways 141 of the inner housing 140, the retainer 160 is first inserted into the retainer receiving depression 142 of the inner housing 140 through the retainer insertion passageway 151 of the outer housing 150. The retainer 160 is then set to the released position, as shown in FIG. 12.

Next, as shown in FIG. 12, the contact 101 is inserted in the contact receiving passageways 141 of the inner housing 140 in which the retainer is set to the released position. The contact 101 inserted in the contact receiving passageways 141 is primarily latched on to by a catch 144 provided within the respective contact receiving passageways 141 of the inner housing 140.

Then, as shown in FIG. 12 and FIG. 13, the tool 210 is inserted into the tool insertion passageway 143, and by pressing a slant face 161 on the retainer 160 by an end 211 of the inserted tool 210, the retainer 160 at the released position is moved to the locked position. Next, as shown in FIG. 13, by moving the retainer 160 to the locked position, the contact 101 inserted in the contact receiving passageways 141 is secondarily latched by the retainer 160.

However, the lever-type connector 100 of FIG. 10 has adopted a configuration where the slant face 161 of the retainer 160 is pressed by the end 211 of the inserted tool 210, in order to move the retainer to the locked position. As a result, with the lever-type connector 100, when moving the retainer 160, there is a problem in that it is not easy to move the retainer 160 to the locked position, since the direction in which the tool 210 is inserted is not the same direction in which the retainer 160 is moved. If the retainer 160 cannot be moved completely to the locked position, the latch onto the contact 101 by the retainer 160 becomes incomplete, and there is a chance that the contact 101 may fall out of the inner housing 140.

SUMMARY

The invention has been made in view of the above problems, and it is an objective of the invention, among other things, to provide a lever-type connector capable of securely and efficiently carrying secondary latching of a contact by a retainer.

The lever-type connector includes an inner housing, an outer housing, a retainer, a slider, a lever and a first and second retainer operation passageway. The inner housing includes a contact receiving passageway for receiving a contact, which is latched by a retainer inserted into the inner housing. The inner housing is inserted into and received by the outer housing. The slider is movable within the outer housing and having a cam groove into which a cam pin provided on the mating connector is inserted. The lever is attached to the outer housing and moves the slider by rotation of the lever. The first retainer operation passageway is positioned on a side surface of the outer housing, while the second retainer operation passageway is located on the slider. The first retainer operation passageway is in communication with the second retainer operation passageway when the slider is set to a mated position.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Hereinafter, a lever-type connector 1 of the invention will be described with reference to the drawings.

Figure 1:
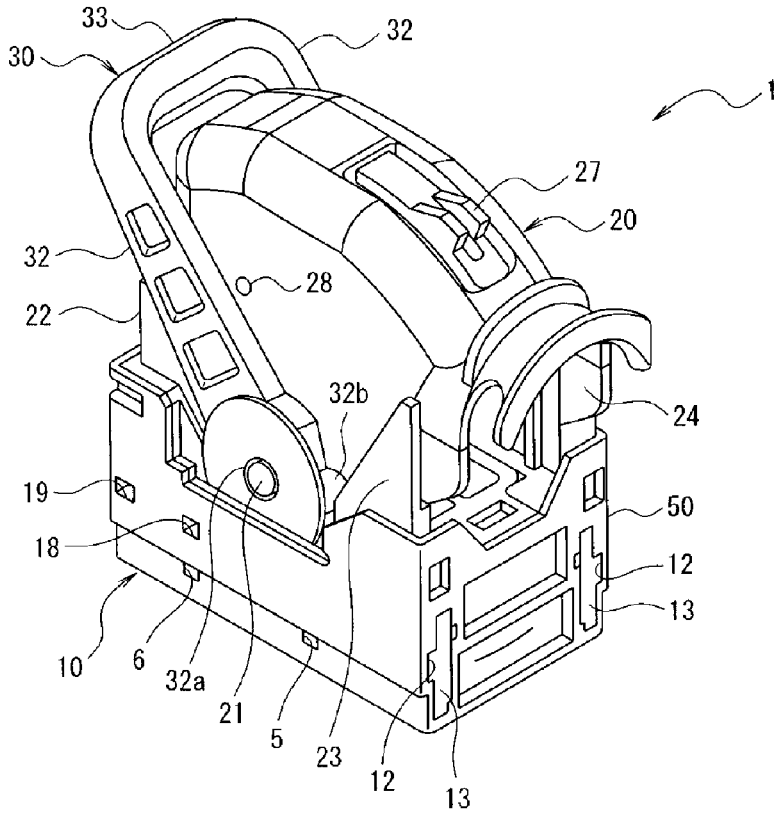
FIG. 1 is a perspective view of a lever of a lever-type connector according to the invention set to a released position.
Figure 2:
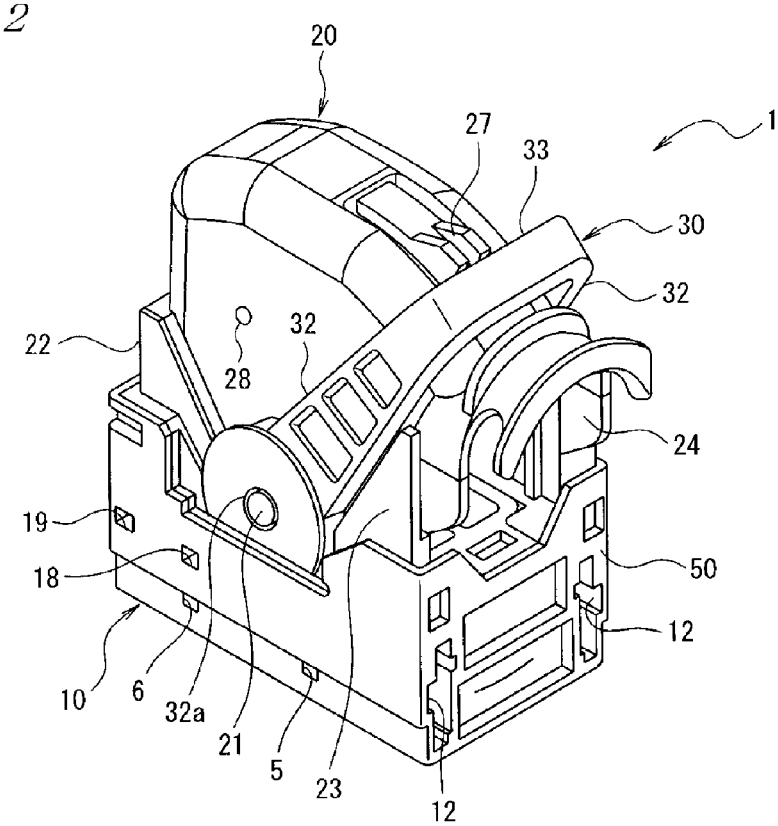
FIG. 2 is a perspective view the lever of the lever-type connector of FIG. 1 set to a mated position.
Figure 3:
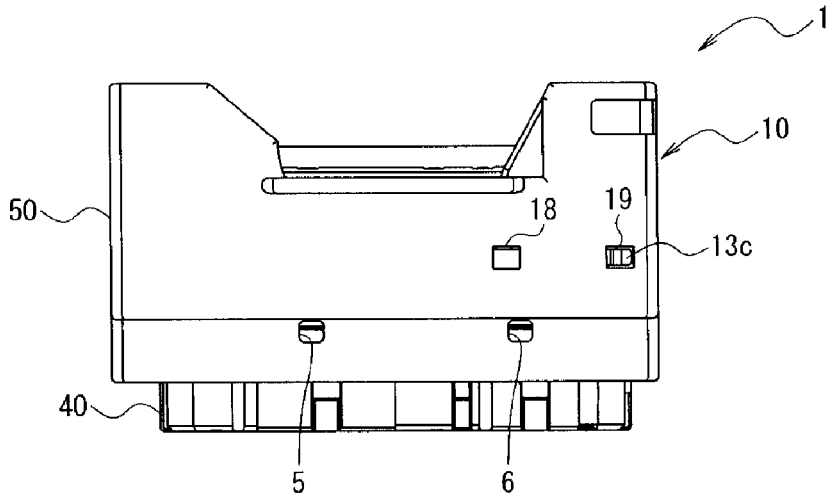
FIG. 3 is a plan view of a housing of the lever-type connector of FIG. 1.

The lever-type connector 1 shown in FIG. 1 and FIG. 2 includes a housing 10, which receives multiple contacts (not illustrated in the drawings), a wire cover 20 attached to a rear side (upper side in FIG. 1 and FIG. 2) of the housing 10, and a lever 30, which is attached to the wire cover 20.

The housing 10 has an inner housing 40, and an outer housing 50 that receives the inner housing 40. The inner housing 40 includes a housing main body 41, a front cover 42 and a first sealing member 43, which are to be attached to the front surface side of the housing main body 41, a second sealing member 44 to be attached to the rear side of the housing main body 41, and a retainer 45 to be inserted into the housing main body 41, as shown in FIG. 5.

Figure 5:
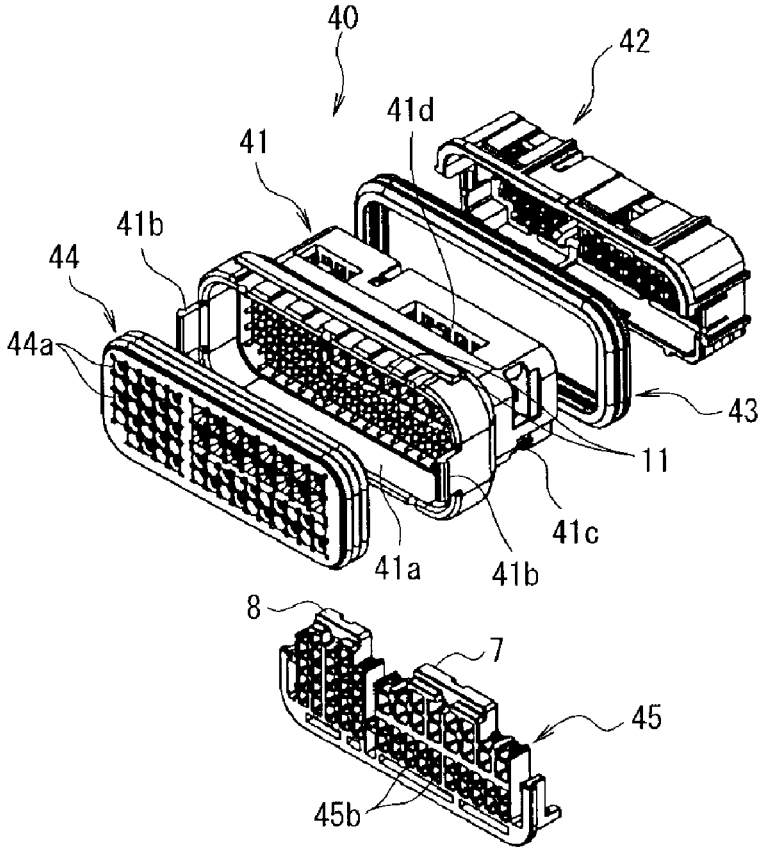
FIG. 5 is a perspective view of a disassembled inner housing of the housing of FIG. 3.

The housing main body 41 has multiple contact receiving passageways 11, as shown in FIG. 5. A catch (not illustrated in the drawing) for primarily latching on to a contact is provided to the respective contact receiving passageways 11. A hood portion 41*a* extending rearward is provided on the rear side of the housing main body 41. Latch arms 41*b* for securing the inner housing 40 to the outer housing 50 are provided on both ends of the hood portion 41*a*. Moreover, a retainer receiving depression 41*c* is provided on the housing main body 41. The retainer receiving depression 41*c* is open downward. Furthermore, two openings 41*d* are provided on the top surface side of the retainer receiving depression 41*c* of the housing main body 41. Respective protrusions 7 and 8 of a retainer 45, which is inserted into the retainer receiving depression 41*c*, penetrate through the two openings 41*d*.

Figure 4:
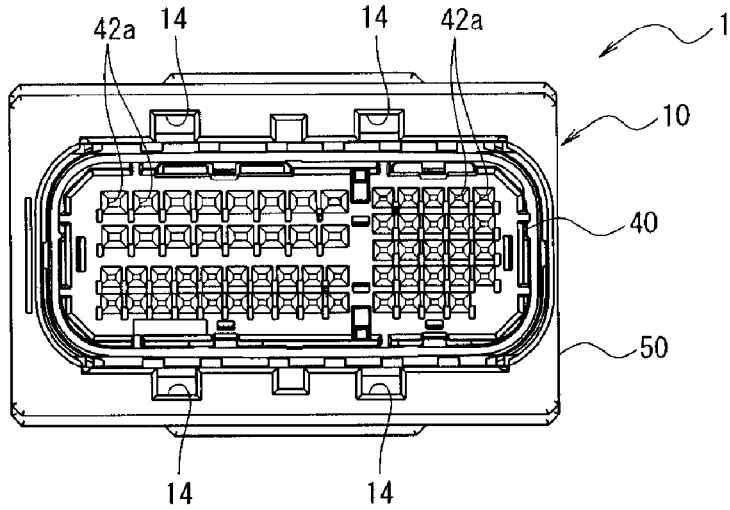
FIG. 4 is a front view of the housing of FIG. 3.

The front cover 42 is formed so as to cover the front surface of the housing main body 41. As shown in FIG. 4, multiple mating terminal insertion passageways 42*a* are provided on the front surface of the front cover 42. The front cover 42 is then attached to the front surface of the housing main body 41.

The first sealing member 43 is formed having a ring form. The first sealing member 43 is then attached to the outer side of the housing main body 41, providing a sealing between the mating connector (not illustrated in the drawing) and the housing main body 41.

The second sealing member 44 is formed having a plate form. Contact insertion passageways 44*a* are provided at positions corresponding to the respective contact receiving passageways 11 in the housing main body 41 of the second sealing member 44. The second sealing member 44 is then received in the hood portion 41*a* of the housing main body 41 and adhered to the outer surface of electrical wires that are lead out from contacts (not illustrated in the drawing) inserted in the respective contact insertion passageways 44*a*, thereby preventing penetration of water into the inner housing 40.

The retainer 45 is formed having a plate form. Contact insertion passageways 44*b* are provided at positions corresponding to the respective contact receiving passageways 11 in the housing main body 41. Two protrusions 7 and 8, which protrude from the respective openings 41*d* when the retainer 45 is inserted into the retainer receiving depression 41*c* of the housing main body 41, are provided on the upper end of the retainer 45.

The retainer 45 is then inserted into the retainer receiving depression 41*c* of the housing main body 41. It is possible to move the retainer 45 inserted into the retainer receiving depression 41*c* of the housing main body 41 between the released position and the locked position. The lever-type connector 1 has a configuration allowing insertion of contacts in the contact receiving passageways 11 of the housing main body 41 when the retainer 45 has been set to the released position. Moreover, it is configured such that the retainer 45 secondarily latches on to the contacts that are inserted in the contact receiving passageways 11 of the housing main body 41 by pushing upward the retainer 45 that is set to the released position to arrange the retainer 45 at the locked position.

As shown in FIG. 2, a slider receiving slot 12 provided on either inner surface of the outer housing 50. A slider 13 is received in each of the slider receiving slots 12, as shown in FIG. 1. The respective sliders 13 are received in a slider receiving slot 12 so as to freely move between a released position (see FIG. 9) and a mated position (see FIG. 7). Two first retainer operation passageways 5 and 6 into which is inserted a tool (not illustrated in the drawing) for operating the retainer 45 are provided laterally to the retainer 45 on either side surface of the outer housing 50. In the housing 10, positions of the respective first retainer operation passageways 5 and 6, which are on the respective side surfaces of the outer housing 50, nearly match positions of the retainer 45 in the front-and-back direction, which is inserted into the inner housing 40 nearly match. The first retainer operation passageway 5 is provided so as to communicate with a second retainer operation passageway 3 of the slider 13 only when the slider 13 is set to the mated position. Moreover, a first retainer operation passageway 6 is provided so as to communicate with the second retainer operation passageway 4 of the slider 13 only when the slider 13 is set to the mated position.

As shown in FIG. 4, four cam pin insertion passageways 14, into which cam pins (not illustrated in the drawing) provided on the mating connector are inserted, are provided on the front surface of the outer housing 50. The respective cam pin insertion passageways 14 are provided so as to communicate with to the respective cam grooves 13*a* of the respective sliders 13 only when the sliders 13 are set to the released position. A first temporary fastening passageway 18 and a second temporary fastening passageway 19, into which projections 13*c* of the respective sliders 13 are joined, are provided on the top and bottom surfaces of the outer housing 50. The first temporary fastening passageway 18 is provided so as to be joined to the respective projections 13*c* of the respective sliders 13 when the sliders 13 are set to the released position. The second temporary fastening passageway 19 is provided so as to be joined to the respective projections 13*c* of the respective sliders 13 when the sliders 13 are set to the mated position.

Each of the sliders 13 (see FIG. 7 and FIG. 9) is formed having a plate shape. Two of the cam grooves 13*a*, which lead in and push out cam pins provided on the mating connector, are provided on the inner surface of each of the sliders 13. Moreover, a rack 13*b* (see FIG. 7 and FIG. 9), with which gears 32*b* of the lever 30 are engaged, is provided on the rear side of the respective sliders 13. Each slider 13 is received in a slider receiving slot 12 of the outer housing 50, and is capable of moving between the released position and the mated position along the side surfaces of the outer housing 50. A projection 13*c* for temporarily fastening the sliders 13 at the released position or the mated position is provided on one end of the respective sliders 13. Each slider 13 is temporarily fastened at the released position by joining the projection 13*c* to the first temporary fastening passageway 18 of the outer housing 50. Each slider 13 is temporarily fastened at the mated position by joining the projection 13*c* to the second temporary fastening passageway 19 of the outer housing 50. Two retainer operation passageways 3 and 4, into which a tool for operating the retainer 45 is inserted, are provided on the respective sliders 13. In the housing 10, positions of the respective second retainer operation passageways 3 and 4 in the front-and-back direction, which are on the respective sliders 13 received in the outer housing 50, nearly match positions of the retainer 45, which is inserted into the inner housing 40. Here, both of the second retainer operation passageways 3 and 4 are provided at a position avoiding the cam grooves 13*a*. This allows prevention of decrease in strength of the sliders 13.

The lever 30 includes a pair of side plates 32 and a connecting part 33 for connecting an end of both of the side plates 32 to each other, as shown in FIG. 1 and FIG. 2. A pivot receiving passageway 32, into which a pivot 21 of the wire cover 20 is joined, is provided on the other ends of both of the side plates 32. Moreover, gears 32*b* that engage with the rack 13*b* of the sliders 13 are provided around the pivot receiving passageway 32*a* on the other ends of both of the side plates 32.

The wire cover 20 is formed in an approximate box shape so as to cover an electrical wire (not illustrated in the drawing) connected to the contact received in the housing 10, as shown in FIG. 1 and FIG. 2. The pivot 21 that joins to the pivot receiving passageway 32*a* of the lever 30 is provided on the front end of the top and bottom surfaces of the wire cover 20.

A first deterring section 22 is provided on one side of the wire cover 20. A second deterring section 23 is provided on the other side of the wire cover 20. The first deterring section 22 deters the lever 30 that has been set to the released position (see FIG. 1) from rotating further toward the one side. The second deterring section 23 deters the lever 30 that has been set to the mated position (see FIG. 2) from rotating further toward the other side. An electrical wire outlet 24, which leads out the bound, electrical wires connected to the contact that is accommodated in the housing 10, is provided on the other end of the wire cover 22.

A lock member 27 for preventing rotation of the lever 30 that has been set to the mated position to the one side is provided on the rear surface of the wire cover 20. The lock member 27 is formed having a cantilever plate-spring form and prevents the lever 30 from rotating toward the one side by intercepting the sides of the connecting part 33 of the lever 30 set to the mated position. A lock projection portion 28 for preventing rotation of the lever 30 that has been set to the released position to the other side is provided on an end of the top and bottom surfaces of the wire cover 20. Each of the lock projection portions 28 prevents rotation of the lever 30 that has been set to the released position to the other side by intercepting the sides of the respective side plates 32 of the lever 30.

An assembling method of the lever-type connector 1 will now be described. The wire cover 20, to which the lever 30 is attached, connects with the housing 10 where the inner housing 40 is received in the outer housing 50 and both of the sliders 13 are received, during an assembly process of the lever-type connector 1.

Figure 6:
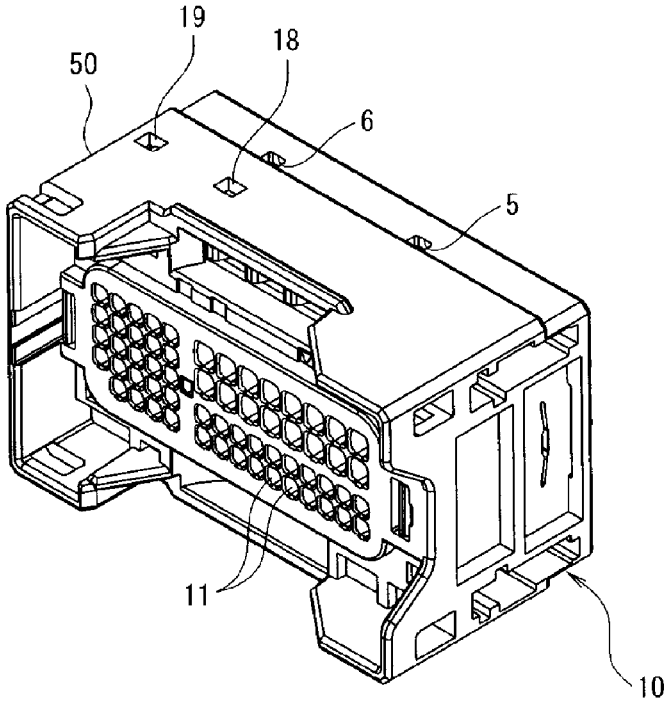
FIG. 6 is a perspective view of a slider of a housing according to the invention set to a mated position.
Figure 7:
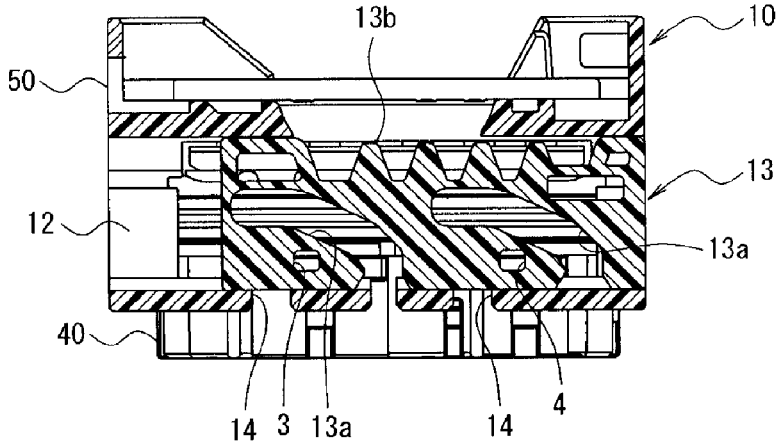
FIG. 7 is a cross-sectional view of the housing of FIG. 6.

The wire cover 20 is fixed by the lock member 27 in order to prevent damage to the lever 30 when the lever 30 is set to the mated position. Moreover, as shown in FIG. 6 and FIG. 7, the housing 10 is introduced into the assembly process in a state where the respective sliders 13 are set to the mated position and the projections 13*c* of the respective sliders 13 are joined to the second temporary fastening passageway 19. As a result, if the wire cover 20 where the lever 30 is set to the mated position is combined with the housing 10 where the respective sliders 13 are set to the mated position in the assembly process of the lever-type connector 1, the respective gears 32*b* of the lever 30 and the rack 13*b* of the respective sliders 13 are properly engaged with together. Furthermore, the housing 10 is assembled in a state where the retainer 45 is inserted into the retainer receiving depression 41*c* of the housing main body 41, and the retainer 45 is set to the released position.

When assembling the lever-type connector 1, the multiple contact receiving passageways 11 of the inner housing 40 first receive respective contacts from the outer housing 50 of the housing 10. The contacts received in the contact receiving passageways 11 are each primarily latched on to by a catch provided within the respective contact receiving passageways 11.

Next, the retainer 45 at the released position is then pushed upward to be moved to the locked position.

Here, the housing 10 in which the sliders 13 are at the mated position is in a state where the first retainer operation passageway 5 is in communication with the second retainer operation passageway 3, and the first retainer operation passageway 6 is in communication with the second retainer operation passageway 4. Accordingly, the bottom surface of the retainer 45 is visible through the corresponding second retainer operation passageways 3 and 4 of the sliders 13 on the bottom surface side of the outer housing 50 and the first retainer operation passageways 5 and 6 on the bottom surface side of the outer housing 50, respectively. As a result, it is possible to insert a tool in a rod shape (no illustrated in the drawing) into the corresponding first retainer operation passageways 5 and 6 and second retainer operation passageways 3 and 4, respectively, and push the bottom surface of the retainer 45 upward by the end of the inserted tool.

According to the lever-type connector 1, securely and efficiently moving of the retainer 45 from the released position to the locked position is possible since direction in which the tool is inserted matches direction in which the retainer 45 is moved.

By moving the retainer 45 to the locked position, the contacts received in the contact receiving passageways 11 of the inner housing 40 are then secondarily latched by the retainer 45.

Here, the lever-type connector 1 is a design allowing external detection of the positions of the respective sliders 13 received in the housing 10. Therefore, with the lever-type connector 1, displacement of the slider 13 cannot be detected externally, even in the case where displacement of the slider 13 that has been temporarily fastened at a mated position within the housing 10 occurs due to impact or the like during transportation of the housing 10.

Consequently, the lever-type connector 1 has a configuration where pushing in of the retainer 45 is performed using a tool since the first retainer operation passageways 5 and 6 and second retainer operation passageways 3 and 4 being successive only when the sliders 13 are at the mated position. Accordingly, when the sliders 13 are not set to the mated position, the first retainer operation passageways 5 and 6 and second retainer operation passageways 3 and 4 are not aligned, and therefore, pushing in of the retainer 45 using a tool is not possible.

As such, according to the lever-type connector 1, detection of displacement of the sliders 13 when moving the retainer 45 is possible. If the outer housing 50 and the sliders 13 have different colors than that of the retainer 45, then the colors facilitates visual detection of displacement of the sliders 13.

The wire cover 20 to which the lever 30 is attached is then attached to the housing 10 in which the retainer 45 has been moved to the locked position. In this case, as described above, the wire cover 20 is in a state where the lever 30 is set to the mated position and the lever 30 is fixed by the lock member 27. Moreover, the housing 10 in which the retainer 45 has been set to the locked position is in a state where the respective sliders 13 are set to the mated position and the projections 13*c* of the respective sliders 13 are joined to the second temporary fastening passageway 19. As a result, the wire cover 20, where the lever 30 is set to the mated position, is combined with the housing 10, where the respective sliders 13 are set to the mated position, thereby properly engaging the respective gears 32*b* of the lever 30 and the rack 13*b* of the respective sliders 13. Where attachment of the wire cover 20 to the housing 10 is complete, the bound, electrical wires connected to the multiple contacts are lead out from the electrical wire outlet 24 of the wire cover 20.

This attaches the wire cover 20 to the housing 10, thereby completing assembly of the lever-type connector 1, as shown in FIG. 2.

Figure 8:
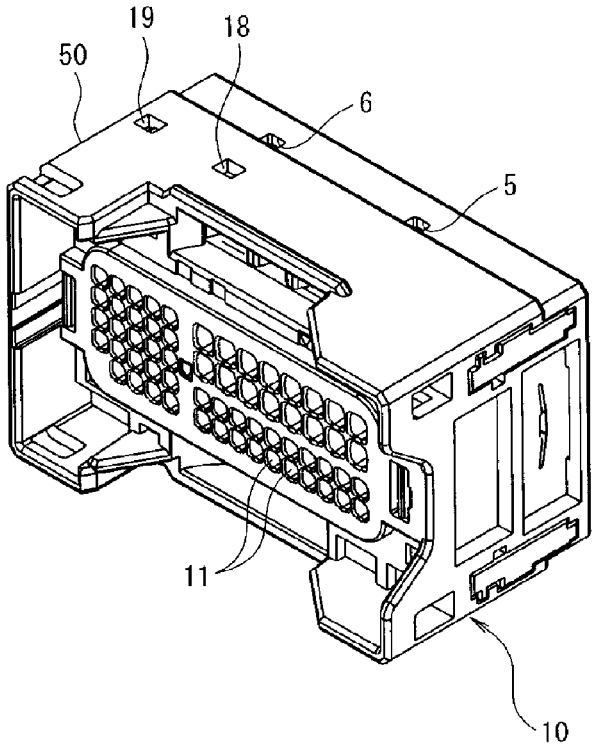
FIG. 8 is a perspective view of a slider of a housing according to the invention set to a released position.
Figure 9:
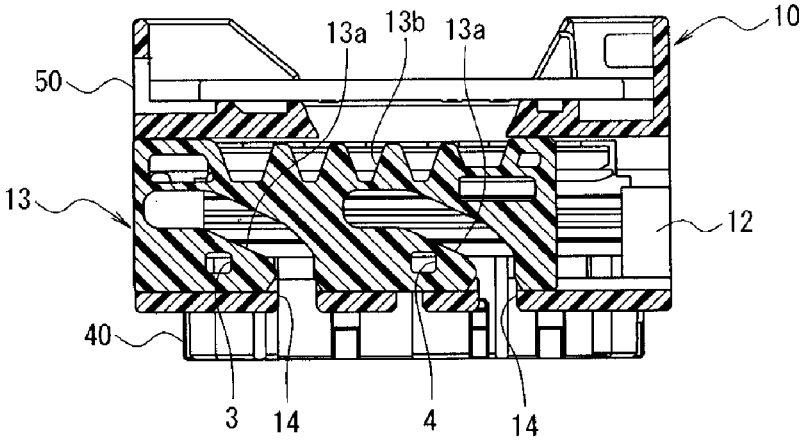
FIG. 9 is a cross-sectional view of the housing of FIG. 8.
Figure 10:
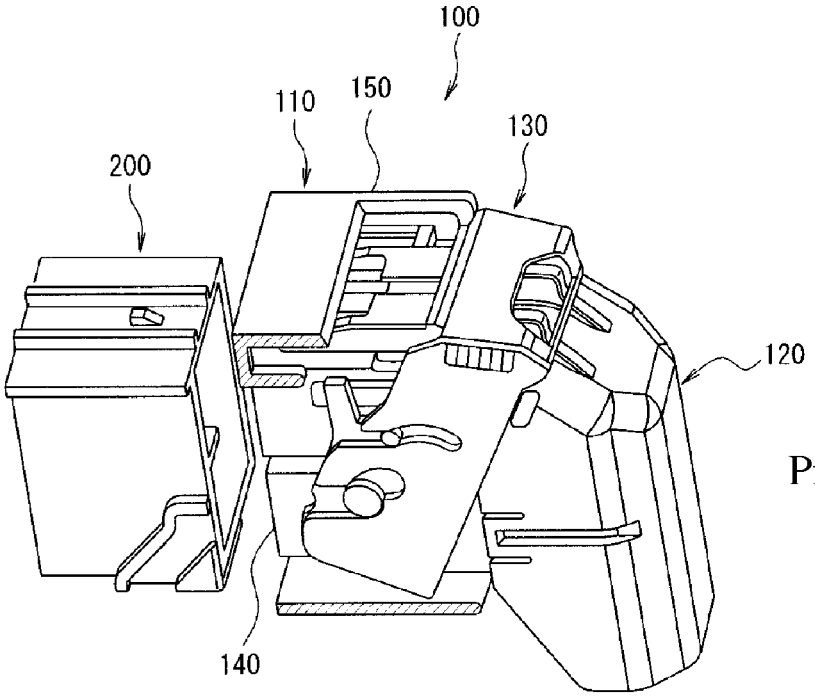
FIG. 10 is a perspective view of a conventional lever-type connector and a mating connector.
Figure 11:
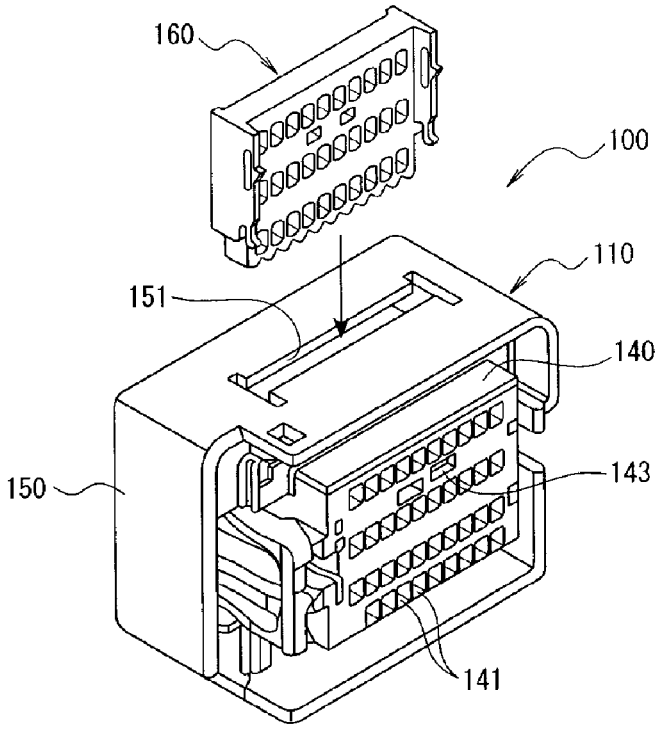
Prior Art F I G. 1 1
FIG. 11 is a perspective view of a housing and a retainer of the lever-type connector of FIG. 10.
Figure 12:
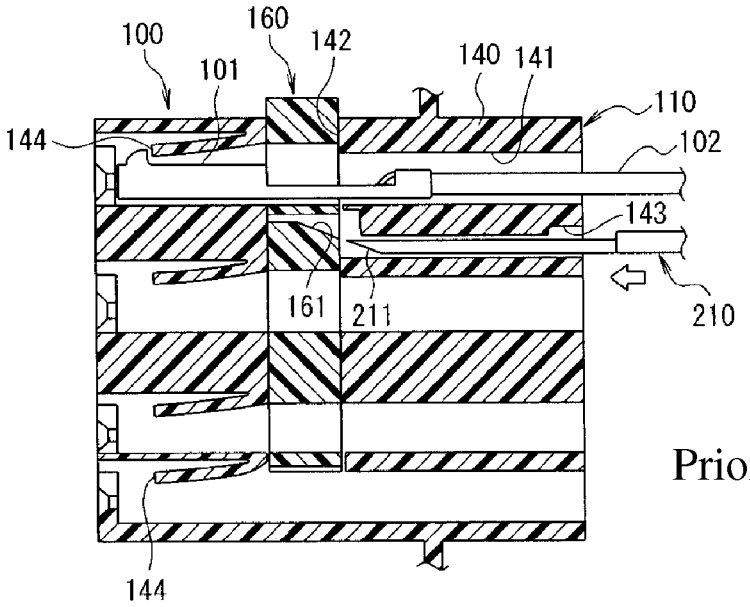
FIG. 12 is a cross-sectional view an inner housing of the conventional lever-type connector, in which a retainer is set to a released position.
Figure 13:
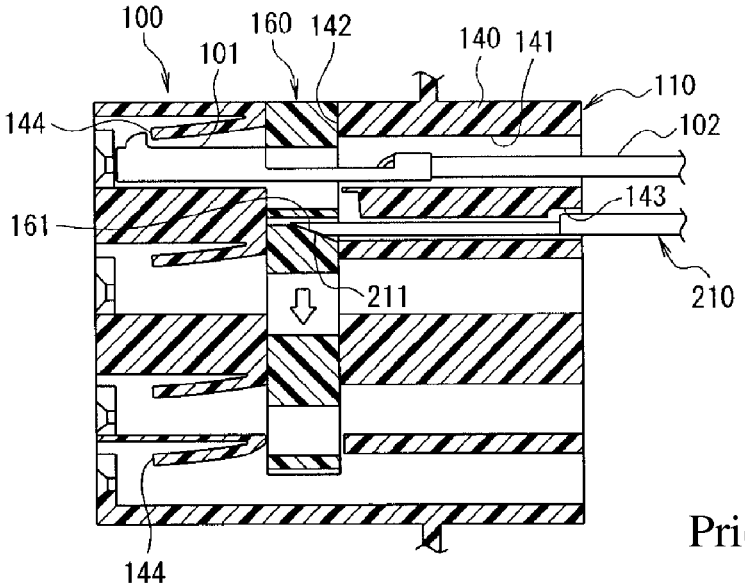
Prior Art F I G. 1 3
FIG. 13 is a cross-sectional view of an inner housing of the conventional lever-type connector, in which the retainer is set to a locked position.

Mechanical use of the lever-type connector 1 will now be described. With the lever-type connector 1, by rotating the lever 30 relative to the housing 10, the gears 32*b* of the lever 30 drive the rack 13*b* of the sliders 13, the sliders 13 are moved. Moreover, if the lever 30 is turned toward the released position, the sliders 13 are moved toward the released position. Furthermore, if the lever 30 is turned toward the mated position, the sliders 13 are moved toward the mated position. In addition, when the lever 30 is set to the released position, the sliders 13 are then set to the released position, as shown in FIG. 8 and FIG. 9. When the lever 30 is set to the mated position, the sliders 13 are then set to the mated position, as shown in FIG. 6 and FIG. 7.

When mating the lever-type connector 1 with a mating connector, the lever 30 is first set to the released position. When the lever 30 has been set to the released position, setting the sliders 13 to the released position results in the respective cam pin insertion passageways 14 of the outer housing 50 in communication with the respective cam grooves 13*a* of the respective sliders 13.

Then, in the state where the lever 30 has been set to the released position, the respective cam pins of the mating connector are inserted in the multiple cam grooves 13*a* of the sliders 13 via the respective cam pin insertion passageways 14 of the outer housing 50, temporarily mating the lever-type connector 1 and the mating connector.

Next, the lever 30 by the lock projection portion 28 of the wire cover 20 is released, and the lever 30 is turned from the released position toward the mated position. Once the lever 30 is turned toward the mated position, the sliders 13 move toward the mating position so that the multiple cam grooves 13*a* of the sliders 13 lead the cam pins, which are provided to the mating connector, toward the rear surface. As a result, the multiple contacts received in the inner housing 40 are mated with contacts received in the mating connector.

The lever 30 is then set to the mated completion position such that the sliders 13 are set to the mated position, thereby completing mating of the lever-type connector 1 and the mating connector. Note that the lever 30 set to the mated position is prevented from rotating toward the released position by the lock member 27 of the wire cover 20.

Meanwhile, when releasing the mating of the lever-type connector 1 and the mating connector, the lock of the lever 30 by the lock member 27 of the wire cover 20 is released, and the lever 30 that has been set to the mated position is turned toward the released position. Once the lever 30 is turned toward the released position, the sliders 13 are moved toward the released position so that the multiple cam grooves 13*a* of the sliders 13 lead the cam pins that are provided to the mating connector out toward the front surface. As a result, the mating of the contacts received in the inner housing 40 of the lever-type connector 1 and the contacts received in the mating connector is released.

Once the lever 30 is turned to the released position, release of the mating of the lever-type connector 1 and the mating connector is then complete.

Next, a method of replacing a contact of the lever-type connector 1 will be described. When replacing a contact of the lever-type connector 1, the lever 30 is first set to the mated position. The wire cover 20 where the lever 30 is set to the mated position is then removed from the housing 10.

Moreover, the housing 10 in which the wire cover 20 has been removed is in a state where the respective sliders 13 are set to the mated position and the projections 13*c* of the respective sliders 13 are joined to the second temporary fastening passageway 19.

Next, the retainer 45 at the locked position is pushed downward to the released position. Here, the housing 10 in which the sliders 13 are at the mated position is in a state where the first retainer operation passageway 5 is communication with the second retainer operation passageway 3, and the first retainer operation passageway 6 is communication with the second retainer operation passageway 4. Accordingly, the top surface of the protrusion 7 of the retainer 45 is visible through either of the communicated second retainer operation passageway 3 on the top surface side of the outer housing 50 or the first retainer operation passageway 5 on the top surface side of the outer housing 50. Moreover, the top surface of the protrusion 8 of the retainer 45 is visible through either of the communicated second retainer operation passageway 4 of the sliders 13 on the top surface side of the outer housing 50 or the first retainer operation passageway 6 on the top surface side of the outer housing 50. As a result, it is possible to insert a rod-shaped tool in the communicated first retainer operation passageways 5 and 6 and second retainer operation passageways 3 and 4, respectively, and push the respective top surfaces of the protrusions 7 and 8 downward using the end of the inserted tool.

In this manner, according to the lever-type connector 1, securely moving of the retainer 45 from the locked position to the released position is possible since direction in which the tool is inserted matches direction in which the retainer 45 is moved.

By moving the retainer 45 to the released position, the contacts, which are received in the contact receiving passageways 11 of the inner housing 40 in the housing 10, are then released.

Once released from the retainer 45, the contacts may be replaced by releasing the primary latches by the catch of the housing 10 using a tool.

While the embodiments of the present invention have been illustrated in detail, various modifications to those embodiments are possible. Those skilled in the art will appreciate that various modifications, additions and substitutions are possible, without departing from the scope and spirit of the invention as disclosed in the accompanying claims. For example, the number of the first retainer operation passageways 5 and 6 and the second retainer operation passageways 3 and 4 in the outer housing 50 may be appropriately increased.

A lever-type connector according to the invention allows secure and efficient movement of a retainer to a released position or a locked position. Moreover, the lever-type connector according to the invention, among other things, allows for detection of slider displacement when moving the retainer. Furthermore, the lever-type connector according to the invention prevents reduction in strength of a slider.

What is claimed is:

1. A lever-type connector, comprising:

an inner housing having a contact receiving passageway for receiving a contact;

a retainer inserted into the inner housing latching the contact;

an outer housing that receives the inner housing;

a slider movable within the outer housing and having a cam groove into which a cam pin provided on a mating connector is inserted;

a lever attached to the outer housing and moving the slider by rotation of the lever;

a first retainer operation passageway positioned on a side surface of the outer housing; and a second retainer operation passageway located on the slider, the first retainer operation passageway is in communication with the second retainer operation passageway when the slider is set to a mated position.

2. The lever-type connector according to claim 1, further comprising cam grooves located on the slider.

3. The lever-type connector according to claim 2, wherein the second retainer operation passageway is positioned to avoid the cam grooves.

4. The lever-type connector according to claim 1, further comprising a hood portion positioned on a rear side of the inner housing.

5. The lever-type connector according to claim 4, further comprising latch arms on both ends of the hood portion and positioned for securing the inner housing to the outer housing.

6. The lever-type connector according to claim 1, further comprising a retainer receiving depression located on the inner housing.

7. The lever-type connector according to claim 6, further comprising two openings located on a top surface side of the retainer receiving depression.

8. The lever-type connector according to claim 7, further comprising respective protrusions located on the retainer and penetrating through the two openings.

9. The lever-type connector according to claim 1, further comprising at least two first retainer operation passageways located on the retainer.

10. The lever-type connector according to claim 9, further comprising at least two second retainer operation passageways located on the slider, wherein the at least two first retainer operation passageways communicate with the at least two second retainer operation passageways respectively.

11. The lever-type connector of claim 1, further comprising a projection positioned on the slider.

12. The lever-type connector of claim 11, further comprising a first temporary fastening positioned on a surface of the outer housing to join with the projection of the slider.

13. The lever-type connector of claim 12, further comprising a second temporary fastening passageway positioned on the surface of the outer housing to join with the projection.

* * * * *